United States Patent [19]

Lawrence et al.

[11] 4,060,861

[45] Dec. 6, 1977

[54] PROTECTIVE DEVICE FOR A TOILET LID

[76] Inventors: Dennis G. Lawrence; Anne M. Lawrence, both of 92 Mount Vernon St., Fitchburg, Mass. 01420

[21] Appl. No.: 685,814

[22] Filed: May 12, 1976

[51] Int. Cl.[2] ..... A47K 13/00

[52] U.S. Cl. ..... 4/253

[58] Field of Search ..... 4/1, 253, 251

[56] References Cited

U.S. PATENT DOCUMENTS

| | | | |
|---|---|---|---|
| 2,698,439 | 1/1955 | Bruckner | 4/253 |
| 3,024,472 | 3/1962 | Hardenbrook | 4/253 |
| 3,056,972 | 10/1962 | Miller | 4/253 |
| 3,116,527 | 1/1964 | Springer | 4/253 X |
| 3,431,004 | 3/1969 | Schell | 4/253 X |

*Primary Examiner*—Henry K. Artis

*Attorney, Agent, or Firm*—Charles R. Fay

[57] ABSTRACT

A protective device in the nature of a latch to hold a toilet lid against being raised by a toddler and comprising a foot that slips under the toilet seat per se from the rear of the toilet bowl and rests on the surface of the toilet bowl, a column thereon which may be adjustable in height, and a relatively enlarged elongated hold-down member on the column and extending over the lid of the toilet from the rear thereof, the foot and hold-down member being rigid.

3 Claims, 3 Drawing Figures

PROTECTIVE DEVICE FOR A TOILET LID

BACKGROUND OF THE INVENTION

There is a distinct possibility that young children just learning to walk or creep (toddlers) can open the lids of toilet bowls, and may fall in. It is the object of the invention to provide a very simple device for preventing such accidents.

SUMMARY OF THE INVENTION

The protective device of the present invention comprises a relatively small flat foot which is adapted to be inserted under the toilet seat from the rear thereof between the hinges therefor and this foot rests on the material of the toilet bowl itself at its rear. On the foot there is a rigid column which may be adjustable in height and at the top of the column is a relatively enlarged elongated hold-down locking device which extends over a certain portion of the lid. The entire device is unitary and rigid, and can be removed and placed on another toilet, as needed.

This device prevents the lid from being lifted because it is essentially rigid and as long as the foot of the device is in flat contacting relation with a portion of the toilet bowl itself being held in this position by the toilet seat, the lid itself may not be raised against the hold-down device.

PREFERRED EMBODIMENT OF THE INVENTION

Figure 1:
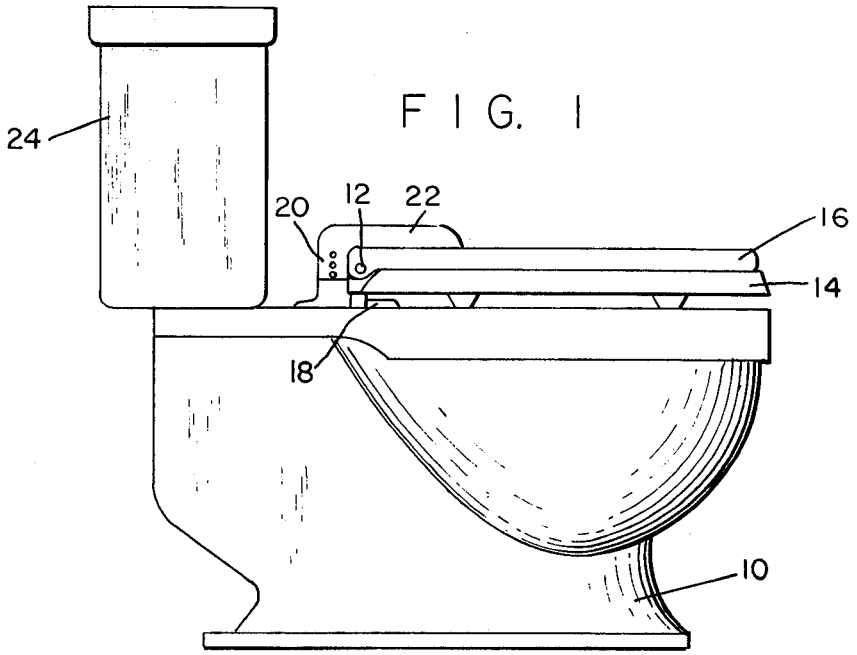
FIG. 1 is a view in side elevation illustrating the protective device applied to a toilet.

Any ordinary toilet bowl being provided with hinges 12 for a toilet seat 14 and an overlying lid 16 may have the protective device of the present invention applied thereto to hold the lid 16 down against accidental opening thereof.

The protective device per se is very simple and it has no permanent connection to the toilet being used on whatever toilet in the house it may be desired and being transferable from one toilet to another. This device comprises essentially a flat foot 18, a rear column 20 thereon and an overlying protective hold-down member 22 which is spaced from the foot substantially the distance which is taken up by the vertical dimensions of the lid and the toilet seat together.

Figure 3:
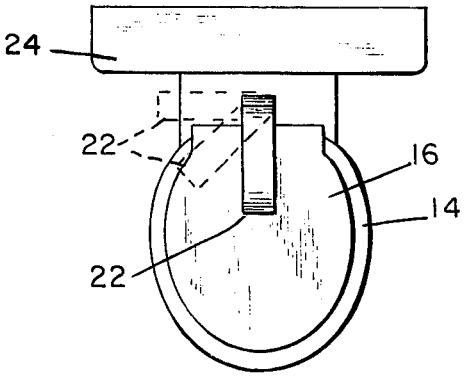
FIG. 3 is a plan view illustrating the application of the device to the toilet.

Referring to FIG. 3 it will be seen how the device is most easily applied. The device is placed at a slight angle (or parallel) with respect to the front surface of the tank indicated at 24, and the foot is slid underneath the toilet seat 14 while still, however, being supported on the toilet bowl. Then this hold-down device is given a turning motion as indicated in solid and dotted lines in FIG. 3. The position of the hold-down member will be in effect on a radius of the lid, with the member 22 in snug association with respect thereto. It will be seen that it is very easy to apply this device for temporary locking of the toilet lid; and it has no fastenings with respect to any part of the toilet and it is completely removable and portable.

Figure 2:
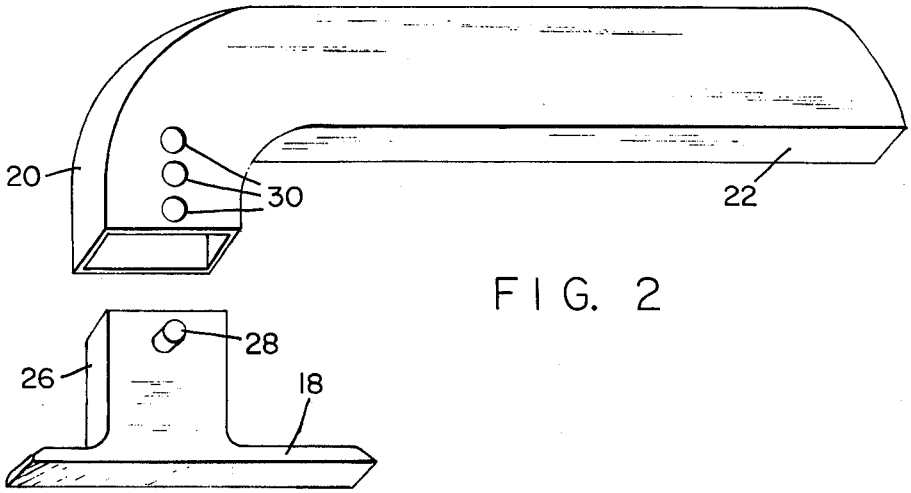
FIG. 2 is an exploded view on an enlarged scale illustrating the protective device itself.

FIG. 2 shows a form of the invention wherein the foot 18 is provided with a hollow column 26 with an extending nob or the like 28 which snap fits into any one of the holes 30 in the side wall of rear column 20 which is hollow and on which is integrally mounted the hold-down latch member 22. Since toilet seats vary in height it is preferred that the device should be manufactured in this way so an adjustment can be made. In order to apply protective latch device 22 to the foot it is merely necessary to apply pressure to the sides of the hollow sections 20 and 26 to get the button 28 to snap into a selected hole 30. This adjustment is easily changed when the device is to be taken off one toilet and applied to another toilet.

We claim:

1. In combination with a toilet including a bowl, a toilet seat, and a lid, a latch for the lid comprising a member including a foot member, a column thereon, and a relatively enlarged and elongated hold-down latching member, the foot member being receivable on the toilet bowl between the toilet bowl and the toilet seat, and the protective hold-down member overlying the lid of the toilet and extending generally radially with respect thereto, the foot and hold-down member being substantially rigid, wherein the column is in two telescoping parts, said parts comprising one part forming a part of the foot member and the other part being a part of the hold-down member, means for adjusting the height of said column by adjusting the parts relatively to each other, and means to secure the parts in adjusted position.

2. The device of claim 1 wherein the securing means comprises a button on one part of the column and a series of apertures vertically aligned in the other part, said apertures being adapted to receive selectively said button in adjusted position thereof.

3. The device of claim 2 wherein the column parts are hollow and open-ended.

* * * * *